US006892660B2

(12) United States Patent
Ketterman

(10) Patent No.: US 6,892,660 B2
(45) Date of Patent: May 17, 2005

(54) FURLING SAIL AND MEANS FOR TURNING MAST

(75) Inventor: Greg Ketterman, Vista, CA (US)

(73) Assignee: Hobie Cat Company, St. Louis, MO (US)

( * ) Notice: Subject to any disclaimer, the term of this patent is extended or adjusted under 35 U.S.C. 154(b) by 0 days.

(21) Appl. No.: 10/758,411

(22) Filed: Jan. 14, 2004

(65) Prior Publication Data

US 2004/0149195 A1 Aug. 5, 2004

Related U.S. Application Data

(60) Provisional application No. 60/443,506, filed on Jan. 28, 2003.

(51) Int. Cl.[7] ..... B63H 9/04
(52) U.S. Cl. ..... 114/102.24; 114/126
(58) Field of Search ..... 114/102.1, 102.24, 114/104, 105, 106, 107

(56) References Cited

U.S. PATENT DOCUMENTS

| | | | | | |
|---|---|---|---|---|---|
| 4,149,482 | A | * | 4/1979 | Hoyt | 114/106 |
| 4,633,798 | A | | 1/1987 | Skinner et al. | |
| 4,838,192 | A | | 6/1989 | Stevenson, IV et al. | |
| 5,333,569 | A | | 8/1994 | Henderson | |
| 5,493,988 | A | * | 2/1996 | Kollberg | 114/106 |
| 5,799,601 | A | * | 9/1998 | Peay | 114/98 |
| 6,575,112 | B2 | * | 6/2003 | Roeseler et al. | 114/253 |

* cited by examiner

*Primary Examiner*—Stephen Avila
(74) *Attorney, Agent, or Firm*—Joseph E. Mueth

(57) ABSTRACT

A sail that is fully battened by a plurality of essentially thin, spaced apart battens positioned at a steep angle on the sail. The sail is adapted to be furled around the mast. The battens are stiff enough to support a large roach of a square top sail and yet flexible enough to wrap around the mast. The mast is supported on bearings that allow the mast to turn about the mast's long axis with little friction to permit rapid furling and unfurling of the fully battened sail.

13 Claims, 7 Drawing Sheets

FURLING SAIL AND MEANS FOR TURNING MAST

Applicant claims the benefit of U.S. Provisional Application No. 60/443,506 filed Jan. 28, 2003.

FIELD OF INVENTION

This invention relates to sailboat battens and specifically to battens intended to be furled around the mast and a means for turning the mast to furl the sail around the mast.

BACKGROUND OF THE INVENTION

On sailboats, it is known to use battens or stiffeners in the sail to increase the amount of sail area for a given mast height and boom length. This extra sail area maintained by battens is called roach. Battens are especially effective for adding sail area up high on a sail. This sail area is very effective at keeping the top of the sail flat and forcing the top of the sail to twist when it is hit by a wind gust. This twisting action reduces the angle of attack of the sail. The combination of less angle of attack and flatter sail reduces the lift and drag generated by the top of the sail which reduces the tendency to heel the boat over. The extra sail area also makes the planform of the sail more closely approximate an ellipse. A sail with elliptical tip is much more efficient than a sail of triangular shape. This relatively recent innovation in sail shape is called a square top sail.

Sailboats also use battens to improve the sail shape. Battens can prevent the sail from luffing and the batten stiffness can be varied to affect sail shape.

Battens also reduce wear and tear on the sail and increase the sail life by reducing the amount of flapping in the wind.

Battens make a boomless option much less of a compromise to sailing performance. The boomless option is desirable because it is safer—no chance of getting hit in the head, less expensive and lighter, and operation of the sail boat is made simpler.

Some sailboats have a mast that can rotate and have the sail furl around the mast. This is a valuable feature because a rotatable mast:

1) Improves safety—the sail can be put away quickly if the wind comes up suddenly.

2) Convenience—the sail can be furled quickly for storage.

3) Adjustability—the sail can be partially furled or reefed.

It is impossible to furl the sail around a mast with conventional battens since the battens are too stiff to wrap around the mast. There are several designs that have been tried to get more roach on sails that are intended to be furled or create battens that can furl:

Short battens known as leech battens have been used on sails when positioned at a steep angle. These sails can furl around the mast, but the battens are too short and do not support much roach when the sail is unfurled.

Henderson U.S. Pat. No. 5,333,569 describes a sail using inflatable battens in the form of hollow, flexible tubes. These sails are believed not to have been tested in the market and they are more complicated, involving pressuring pumps and valved fittings, and are slow and inconvenient to use. There is always the concern that there will be a leak.

Stevenson U.S. Pat. No. 4,838,192 describes pivoting battens that can be rotated from near horizontal when the sail is unfurled to vertical when the sail is furled into a bag at the forward edge of the sail by a control line. The battens are each supported by a plurality of guide loops stitched to the sail which allow the battens to move lengthwise with respect to the guide loops. This battened sail is more complicated to manufacture and use.

Skinner U.S. Pat. No. 4,633,798 describes a sail having a plurality of short battens positioned near the leech edge made of a thin band of steel with a cross section that is curved to give the band stiffness much like an ordinary steel tape measure. If the batten is bent beyond a certain point, the cross section is forced to flatten out and then the batten is flexible and can furl around a mast. This approach has not been tested in the market and it is not known if the battens can flex far enough to support a large roach without yielding by bending over or kinking. The sail with steel bands must also be handled with care since repeated furling and unfurling could result in the development of unwanted permanent deformation or creasing of the steel battens.

A square top sail is offered on the Hobie Outback kayak which has a single, steeply angled batten which can furl around the mast but the boat has no means for furling the sail.

SUMMARY OF THE INVENTION

Briefly, the present invention comprises the combination on a sailboat of a mast and a sail that is fully battened, said sail being adapted to be furled around the mast, said battening being stiff enough to support a large roach of a square top sail and yet flexible enough to wrap around the mast, said mast being supported on bearings that allow the mast to turn about the mast's long axis with little friction to permit rapid furling and unfurling of the fully battened sail.

The invention further comprises the combination on a sailboat of a mast and sail carried by said mast, the sail being fully battened by a plurality of essentially thin, spaced apart battens positioned at a steep angle on the sail, said sail being adapted to be furled around the mast, said battens being stiff enough to support a large roach of a square top sail and yet flexible enough to wrap around the mast, said mast being supported on bearings that allow the mast to turn about the mast's long axis with little friction to permit rapid furling and unfurling of the fully battened sail.

Still further, the invention comprises the combination on a sailboat of a mast and a sail that is fully battened, said sail being adapted to be furled around the mast, said battening being stiff enough to support a large roach of a square top sail and yet flexible enough to wrap around the mast, said mast being supported on bearings that allow the mast to turn about the mast's long axis with little friction to permit rapid furling and unfurling of the fully battened sail, the lower end of said mast being freely rotatably on a mast base located in the main boat structure, above said mast base, a mast bearing housing within which the mast freely rotates, said mast bearing housing being laterally supported by an A-frame structure attached to the main boat structure.

A rope or furling line is wrapped around the mast so that when the rope is pulled it applies a torque to the mast that rotates the mast and furls the sail.

OBJECTS AND ADVANTAGES

Accordingly, several objects and advantages of the invention are to provide a sail that has all of the benefits of a fully battened sail that can still be readily furled around the mast.

The advantages of being able to furl the sail around the mast are;

1) Improves safety—the sail can be put away quickly if the wind comes up suddenly.

2) Convenience—the sail can be furled quickly for storage.

3) Adjustability—the sail can be partially furled for reefing which is sailing with a reduced sail area.

This invention provides all the advantages of a square top sail and it can be furled easily around the mast and it is only a small modification to conventional sail making techniques. There are no mechanisms required for inflating battens as in some of the prior art. There are no extra controls needed as in the prior art.

It is also an object of the invention to be able to furl the sail by pulling a single line. In order to achieve this the mast must have very little resistance to spinning.

DESCRIPTION OF DRAWINGS

In the drawings:

FIG. 3A is an enlarged perspective view of the encircled area of FIG. 3.

DESCRIPTION OF THE PREFERRED EMBODIMENT

Figure 1:
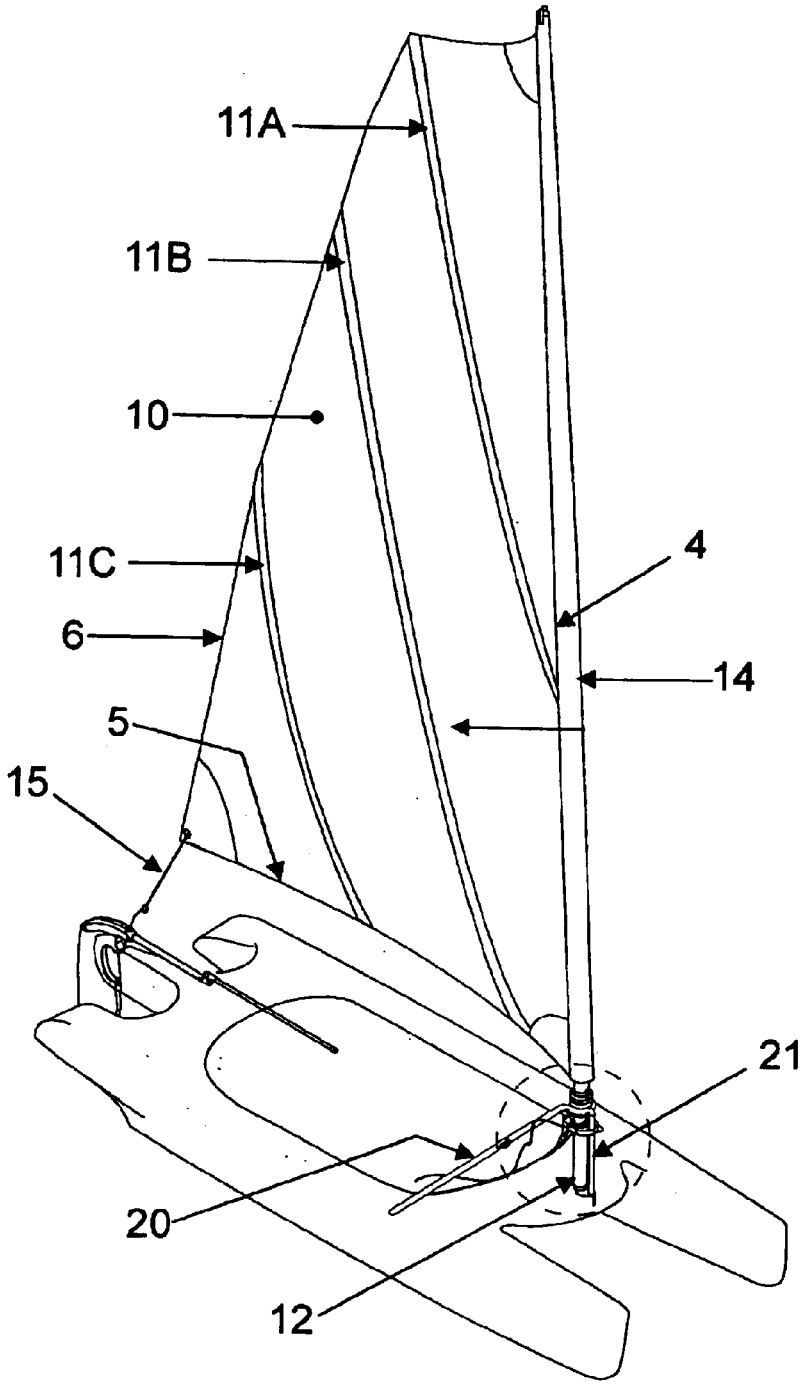
FIG. 1 is a perspective view of the sail on a catamaran.
Figure 2:
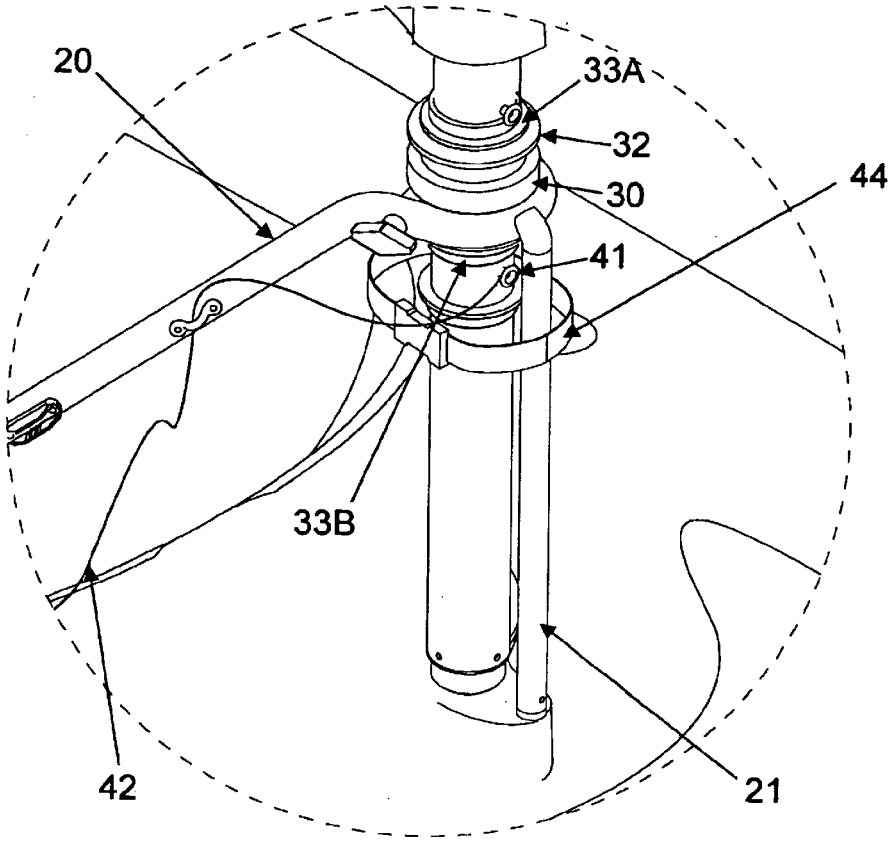
FIG. 2 is the same as FIG. 1 but enlarged to show more detail in the mast base area.
Figure 3:
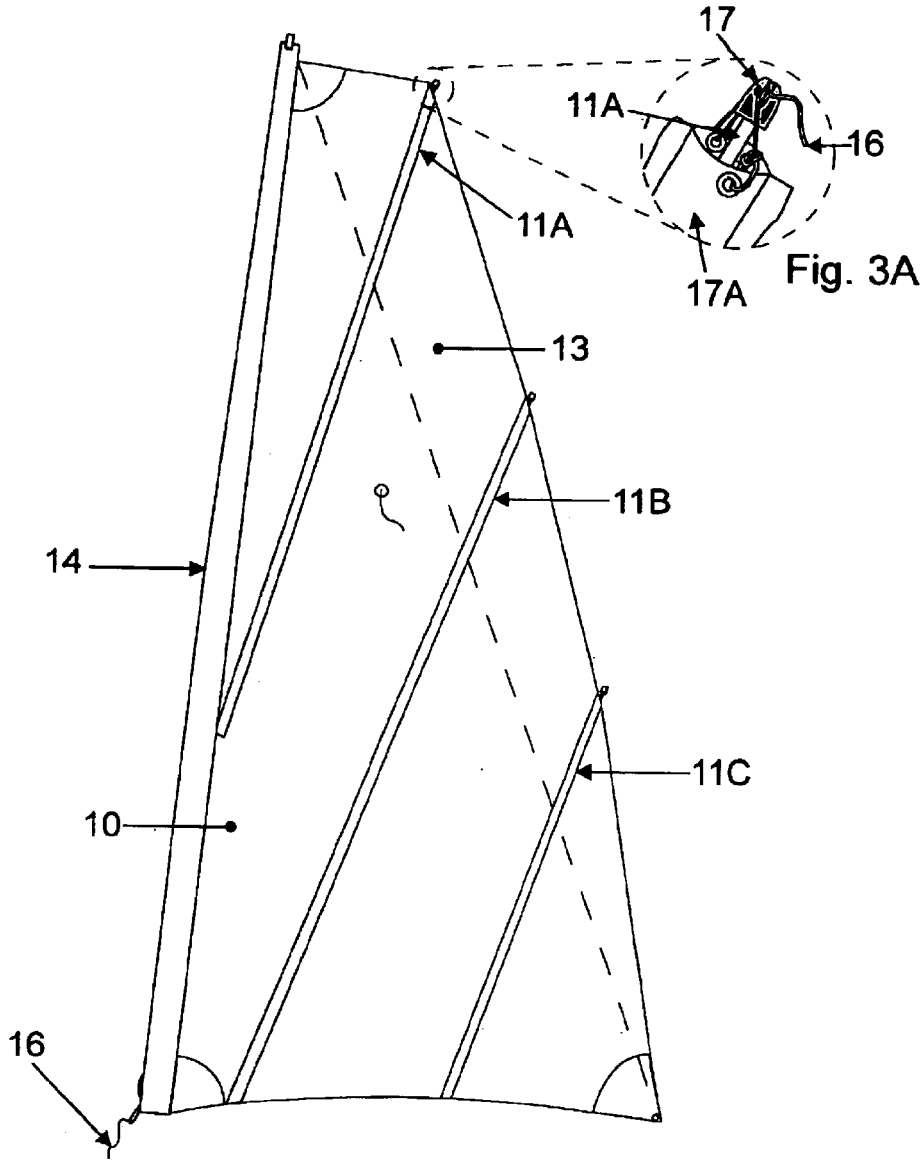
FIG. 3 is a side view of the sail.
Figure 4:
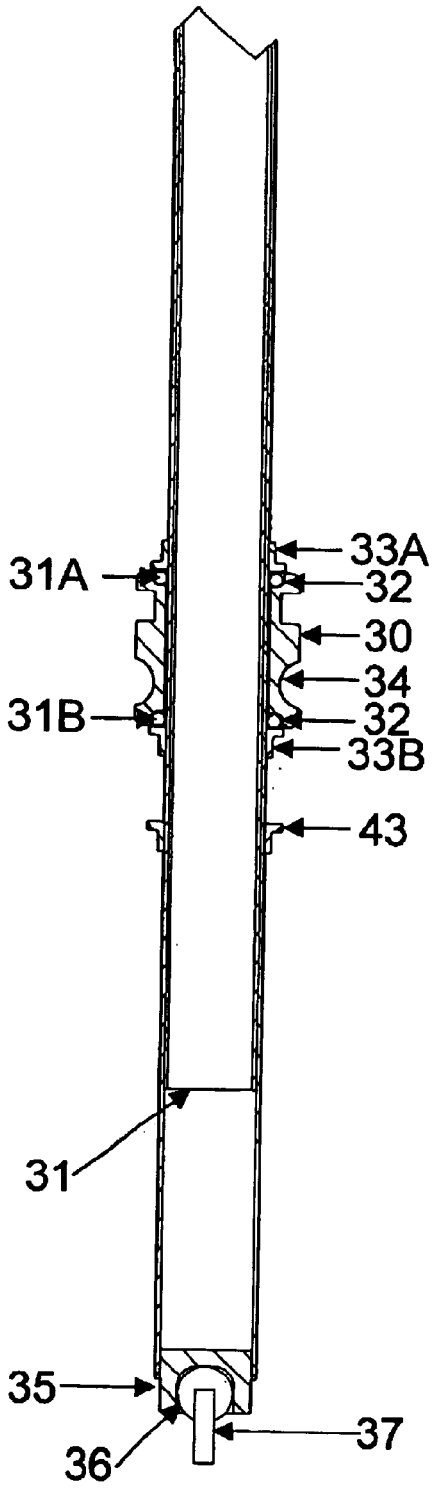
FIG. 4 is a cut away view of the lower mast.
Figure 5:
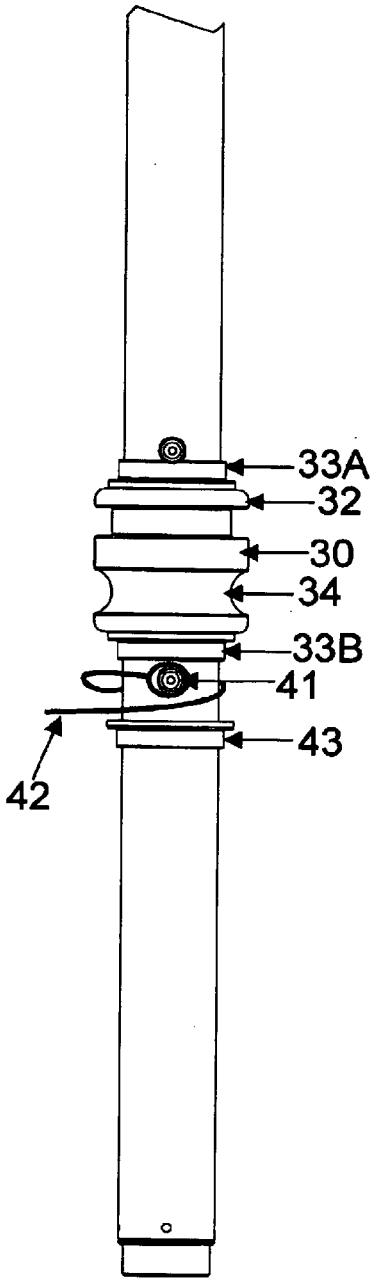
FIG. 5 is a detail view of the lower mast.
Figure 6:
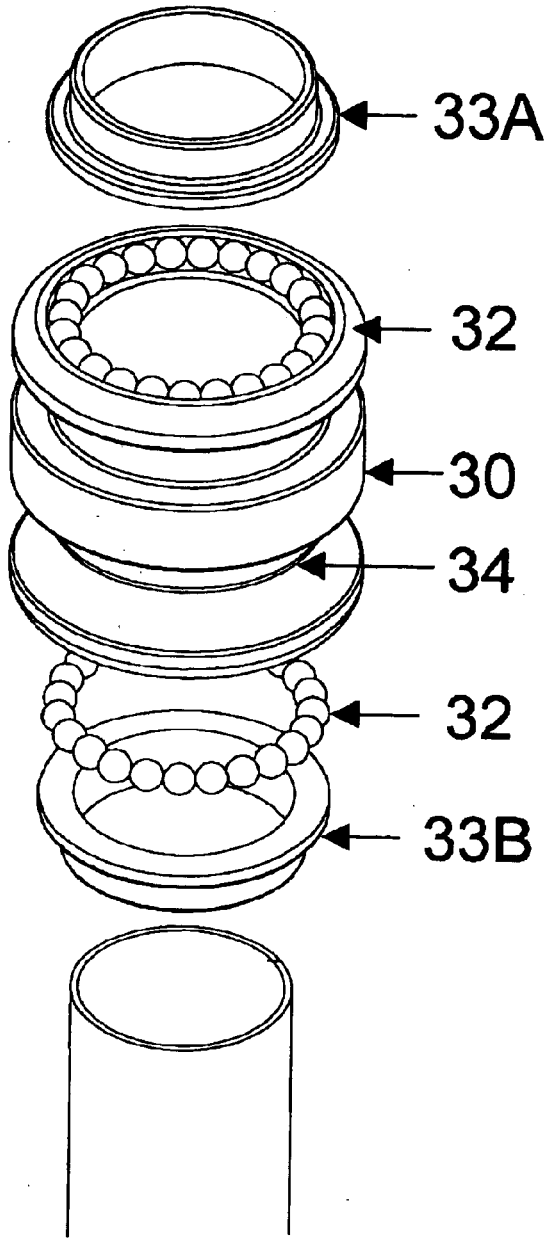
FIG. 6 is an exploded view of the ball bearings.
Figure 7:
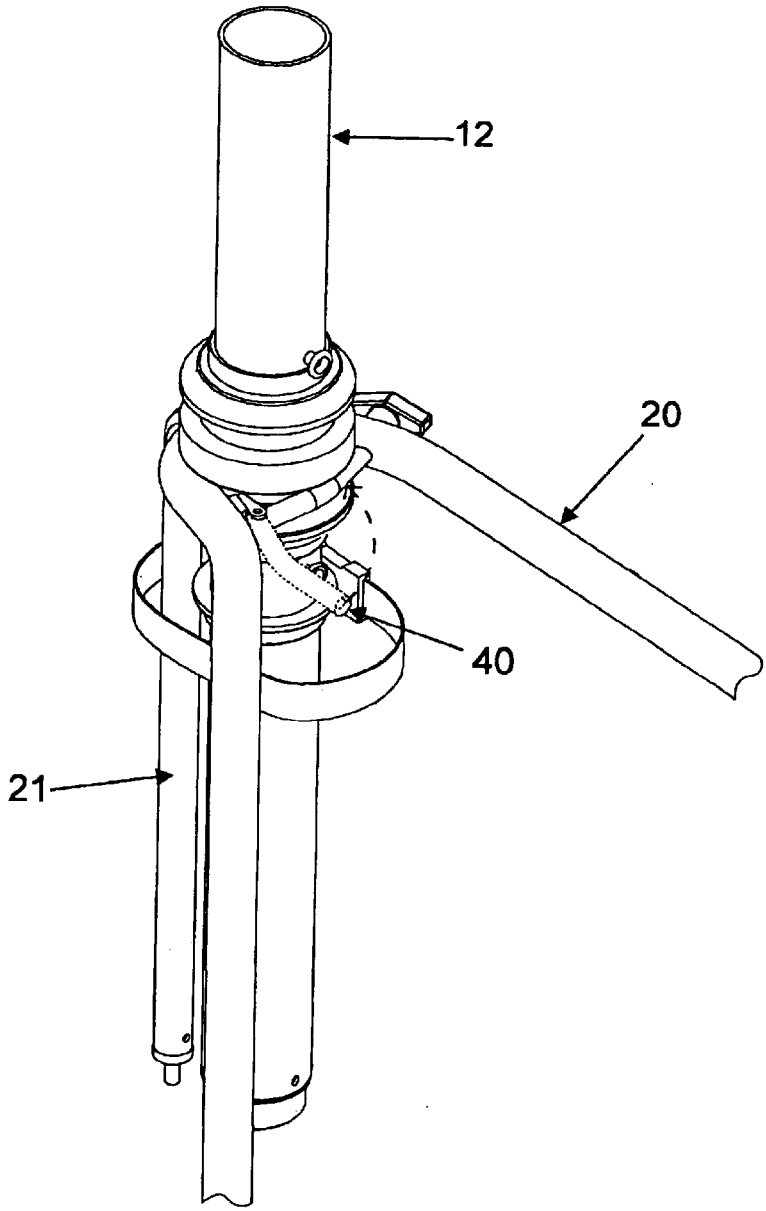
FIG. 7 is a perspective view showing the mast, mast keeper and A-frame.

Turning to the drawings in more detail, one preferred embodiment is a sailboat with a square top sail 10. A square top sail is characterized by a sail having a near horizontal top edge or the sail has a lot of roach 13 up high. Roach 13 is the area of the sail that is behind a line drawn between the head of the sail and the clew. The preferred sail has three battens 11A, 11B, & 11C that are all evenly spaced and parallel to each other and form an angle with the mast 12. Preferably, the battens run essentially from the forward edge 4 or foot 5 of the sail to the leech edge 6. For this embodiment the battens form an angle with mast 12 of about 13°, the sail has an area of 86 square feet, and batten 11A is 10 feet long, 11B is 11 feet and 9 inches, and 11C is 5 feet and 8 inches. The battens 11A, 11B, and 11C are made of 3/16 inch in diameter pultruded fiberglass rod. The battens can be formed by pultrusion from fiberglass reinforced polymeric materials known in the art such as epoxy or polyethylene terephthalate. A sail sleeve 14 is sewn to the luff of the sail 10 and the mast 12 is slid inside the sleeve 14. The primary sail control is the mainsheet 15. The downhaul 16 pulls down on the tack.

The battens 11 are held in place with cord 16 and threaded through a batten cap 17. The lower ends of the battens are free to rotate inside the batten pocket 17A.

This invention uses relatively thin and essentially round in cross-section battens that can simply wrap around the mast when the battens are placed at a steep angle—preferably about 10 to 30 degrees, and more preferably, about 13 degrees from the mast.

The mast 12 preferably is a two piece mast and the top section can be slid into the inside of the lower section. The lower mast is 2.5" outside diameter by 0.078" wall aluminum tube and the upper mast is 2.25" outside diameter by 0.125" wall pultruded fiberglass tube. The lower mast is reinforced in the area of the upper mast bearing housing 30 by an aluminum tube 31.

The A-frame 20 supports the mast bearing housing 30 which in turn supports the mast 12. The vertical strut 21 supports the front of the A-frame 20.

The mast base 35 has a socket made of an engineering plastic such as acetal to receive the mast ball 36 which is also made of acetal. The mast ball 36 is supported by an upright stainless steel shaft 37 and is free to spin on the shaft 37.

A second bearing is located on the mast 12 and centered about 17" above the base of the mast. This bearing consists of a mast bearing housing 30 made of an engineering plastic like acetal or nylon and has two races 31A & 31B to receive acetal ball bearings 32. The ball bearings 32 are held in place by two collars 33A & 33B which are riveted to the mast.

The mast bearing housing 30 has a groove 34 that can receive the A-frame 20 tube. The mast keeper 40 is a stainless steel rod that holds the bearing housing 30 into the A-frame 20.

Just below the upper bearing is a post 41. Pull cord means in the form of furling line 42 can be looped over and affixed or tied to this post 41. A collar 43 is placed below the post to prevent the furling line from falling down. A piece of nylon webbing 44 is fixed to the vertical strut 21 and is wrapped around the mast to further prevent the furling line 42 from falling down and to act as a back up to prevent the mast 12 from falling down if the mast keeper 40 fails. By manually pulling on the free end of furling line 42, the mast 12 is rotated about its long vertical axis, thereby rapidly furling and unfurling sail 10. In general, any means for rotation of the mast about its long axis is contemplated such as, in addition to the pull cord means, a cable wrapped around the mast, a wrench or a gear system. The means for rotation is not meant to include the manual wrapping of the sail around the mast.

What is claimed is:

1. The combination on a sailboat of a mast and a sail that is fully battened, said sail being adapted to be furled around the mast, said battening being stiff enough to support a large roach of a square top sail and yet flexible enough to wrap around the mast, said mast being supported on bearings that allow the mast to turn about the mast's long axis with little friction to permit rapid furling and unfurling of the fully battened sail, said battening comprises a plurality of battens which run at a steep angle essentially from the forward edge and the foot to the leech edge of the sail.

2. The combination of claim 1 wherein there are three equally spaced apart battens.

3. The combination of claim 1 wherein the battens are essentially round in cross-section.

4. The combination of claim 1 further including means for rotation of the mast about its long axis whereby the sail is rapidly furled about the mast.

5. The combination of claim 4 wherein the means for rotation is pull cord means connecting with said mast whereby the sail is rapidly furled about the mast by pulling on said pull cord means.

6. The combination on a sailboat of a mast and sail carried by said mast, the sail being fully battened by a plurality of essentially thin, spaced apart battens positioned at a steep angle on the sail, said battens running essentially from the forward edge and the foot to the leech edge of the sail, said sail being adapted to be furled around the mast, said battens being stiff enough to support a large roach of a square top sail and yet flexible enough to wrap around the mast, said mast being supported on bearings that allow the mast to turn about the mast's long axis with little friction to permit rapid furling and unfurling of the fully battened sail.

7. The combination of claim 6 where there are three equally spaced apart battens.

8. The combination of claim 6 wherein the battens are essentially round in cross-section.

9. The combination on a sailboat of a mast and a sail that is fully battened, said sail being adapted to be furled around the mast, said battening being stiff enough to support a large roach of a square top sail and yet flexible enough to wrap around the mast, said mast being supported on bearings that allow the mast to turn about the mast's long axis with little friction to permit rapid furling and unfurling of the fully battened sail, the lower end of said mast being freely rotatably on a mast base located in the main boat structure, above said mast base, a mast bearing housing within which the mast freely rotates on bearings, said mast bearing housing being laterally supported by an A-frame structure attached to the main boat structure.

10. A sail for use on a sailboat and adapted to be carried by a mast, said sail being fully battened, said sail being adapted to be furled around the mast, said battening being stiff enough to support a large roach of a square top sail and yet flexible enough to wrap around the mast, said battening comprising a plurality of battens which run at a steep angle essentially from the forward edge and the foot to the leech edge of the sail.

11. The sail of claim 10 wherein said sail is fully battened by a plurality of essentially thin, spaced apart battens positioned at a steep angle on the sail.

12. The sail of claim 10 wherein there are three equally spaced apart battens.

13. The sail of claim 10 wherein the battens are essentially round in cross-section.

* * * * *